US006128779A

United States Patent [19]

Goldsmith et al.

[11] Patent Number: 6,128,779

[45] Date of Patent: Oct. 10, 2000

[54] LIMB PROTECTOR

[75] Inventors: Edward M. Goldsmith, Granada Hills; Duncan G. Robins, Woodland Hills, both of Calif.

[73] Assignee: Jas D. Easton, Inc., Van Nuys, Calif.

[21] Appl. No.: 08/971,087

[22] Filed: Nov. 14, 1997

[51] Int. Cl.[7] ..... A41D 13/06

[52] U.S. Cl. ..... 2/22; 2/911

[58] Field of Search ..... 2/22, 16, 24, 62, 2/908, 910, 911, 312, 321, DIG. 3; 602/16, 20, 23, 26

[56] References Cited

U.S. PATENT DOCUMENTS

| | | | |
|---|---|---|---|
| 724,444 | 4/1903 | Curtiss . | |
| 844,041 | 2/1907 | Owens | 2/22 |
| 1,602,454 | 10/1926 | Riddell . | |
| 1,721,739 | 7/1929 | Kennedy . | |
| 1,931,524 | 10/1933 | Becket | 2/22 |
| 2,093,888 | 9/1937 | Holtje . | |
| 2,194,903 | 3/1940 | Holstein . | |
| 2,609,537 | 9/1952 | Pfaff . | |
| 2,657,385 | 11/1953 | Cushman et al. . | |
| 2,664,567 | 1/1954 | Nichols . | |
| 3,039,109 | 6/1962 | Simpson . | |
| 3,135,964 | 6/1964 | Pender . | |
| 3,186,004 | 6/1965 | Carlini . | |
| 3,609,764 | 10/1971 | Morgan . | |
| 3,668,704 | 6/1972 | Conroy et al. . | |
| 3,713,640 | 1/1973 | Morgan . | |
| 3,735,419 | 5/1973 | Byrd . | |
| 3,761,959 | 10/1973 | Dunning . | |
| 3,761,960 | 10/1973 | Woodcock . | |
| 3,784,985 | 1/1974 | Conroy . | |
| 3,849,801 | 11/1974 | Holt et al. . | |
| 3,945,047 | 3/1976 | Jarrell . | |
| 3,999,220 | 12/1976 | Keltner . | |
| 4,023,213 | 5/1977 | Rovani . | |
| 4,067,063 | 1/1978 | Ettinger . | |
| 4,266,298 | 5/1981 | Graziano . | |
| 4,287,613 | 9/1981 | Schulz . | |
| 4,354,284 | 10/1982 | Gooding . | |
| 4,370,754 | 2/1983 | Donzis . | |

(List continued on next page.)

OTHER PUBLICATIONS

Color copies of specified pages of a Canstar Catalog titled "HOCKEY TO THE WORLD U.S.A. 1994", including outside and inside front and back cover pages, index (page 1), and pp. 50–52, 61–62 (noted copyright 1994 Canstar Sports Group Inc.

*Primary Examiner*—John J. Calvert
*Assistant Examiner*—Tejash D Patel
*Attorney, Agent, or Firm*—Lyon & Lyon LLP

[57] ABSTRACT

A limb protector comprising a knee element. In a preferred embodiment the knee element is pivotally coupled to an outer shell shin element. Padding is positioned between the leg and the outer shell(s) and may be formed of a shock absorbent foam, a plurality of interconnected fluid filled cushions, or a combination thereof. The padding may be coupled to the outer shell shin element so as to create a gap between itself and the outer shell shin element. Alternatively, the padding may positioned on the lateral and medial sides of the outer shell knee element to cradle the underlying leg. The outer shell shin element comprises a raised groove element protruding outward from the shin to form a shin-knee transition cavity located between the shin-knee transition of the leg and the outer shell shin element. The outer shell knee element comprises a centrally positioned domed element protruding outward from the knee generally overlying the patella and may also overlie the shin-knee transition area. The outer shell knee element may also have a tongue element extending downward toward the ankle so as to interlock within the raised groove element. The padding element may comprise a U-shaped opening positioned underneath the raised groove and above the shin-knee transition of the leg and an elongated flange element in overlapping configuration with a portion of the padding that is located below the U-shaped opening. The padding element and the outer shell element(s) are configured so that the shin-knee transition area and the patella do not absorb force.

35 Claims, 11 Drawing Sheets

U.S. PATENT DOCUMENTS

| | | | |
|---|---|---|---|
| 4,375,108 | 3/1983 | Gooding . | |
| 4,486,901 | 12/1984 | Donzis . | |
| 4,512,037 | 4/1985 | Vacanti . | |
| 4,513,449 | 4/1985 | Donzis . | |
| 4,674,157 | 6/1987 | Litz . | |
| 4,692,946 | 9/1987 | Jurga . | |
| 4,700,403 | 10/1987 | Vacanti . | |
| 4,751,748 | 6/1988 | Ekins | 2/22 |
| 4,853,980 | 8/1989 | Zarotti . | |
| 4,884,561 | 12/1989 | Letson | 128/77 |
| 4,945,571 | 8/1990 | Calvert . | |
| 4,999,847 | 3/1991 | Barcelo . | |
| 5,007,111 | 4/1991 | Adams | 2/22 |
| 5,034,998 | 7/1991 | Kolsky . | |
| 5,035,009 | 7/1991 | Wingo, Jr. et al. . | |
| 5,129,107 | 7/1992 | Lorenzo . | |
| 5,235,703 | 8/1993 | Maynard . | |
| 5,263,203 | 11/1993 | Kraemer et al. . | |
| 5,274,846 | 1/1994 | Kolsky . | |
| 5,423,087 | 6/1995 | Krent et al. . | |
| 5,435,009 | 7/1995 | Schild et al. . | |
| 5,452,475 | 9/1995 | Hunt . | |
| 5,477,559 | 12/1995 | Clement . | |
| 5,524,292 | 6/1996 | Hargens . | |
| 5,537,688 | 7/1996 | Reynolds et al. . | |
| 5,561,857 | 10/1996 | Hoshizaki et al. . | |
| 5,611,080 | 3/1997 | Skottheim . | |
| 5,625,896 | 5/1997 | LaBarbera et al. . | |
| 5,652,956 | 8/1997 | Hoshizaki et al. | 2/22 |

LIMB PROTECTOR

FIELD OF THE INVENTION

The present invention relates to limb protection apparatuses.

BACKGROUND OF THE INVENTION

It is conventional in the sport of ice hockey, soccer and other similar sports for the participants to wear leg protectors that protect their shin and/or knee areas. Examples of leg protectors are set forth in U.S. Pat. Nos. 3,135,964, 3,735,419, 4,888,826, 4,999,847 and 5,611,080. The entire contents of each of these patents is incorporated herein by reference, as if fully set forth herein. Furthermore, for those occupations where the worker must frequently kneel, such as in floor tile or wood flooring work, the protection of the leg of the worker is needed for sustained and comfortable kneeling without injury to the leg.

Leg protectors have conventionally employed a rigid outer shell generally comprised of one or more interconnected outer shell components that are positioned to overlie shock absorbent padding. The shock absorbent padding is suitably attached usually by stitches or rivets to the outer shell component(s) so as to lie in direct contact with the wearer's leg. When a force or impact is received by the outer shell the underlying shock padding functions to attenuate the given force or impact.

In some leg protectors, the shock absorbent padding and outer shell component(s) are in spaced attachment so as to create an air cavity between the outer shell and the shock absorbent padding. The spaced attachment of the shock absorbent padding to the outer shell functions as a cantilever mechanism. In operation, a force applied against the rigid outer shell at a point above the air cavity transfers the force to the shock absorbent padding and flexes the shock absorbent padding relative to the rigid outer shell. Such a force may stem from an impact by a hockey stick, puck, soccer ball or the like. The result is that the force is absorbed by the flexing and the shock absorbent qualities of the padding and is dissipated across the area of the wearer's leg underlying the shock absorbent padding.

A consequence of the force induced flexing of the cantilever mechanism construction is a reduction in the air cavity. FIG. 12A illustrates the air cavity 4 of a cantilever mechanism when no force is applied. In contrast, FIG. 12B illustrates the reduction of the air cavity 4 of the cantilever mechanism when force is applied. FIGS. 12A and 12B specifically illustrate a top cross-sectional view of the leg of the wearer 1, the shock absorbent padding 2 that is attached to the peripheral of the rigid outer shell component 3 along the lateral and medial sides of the leg, and an air cavity 4 generally positioned between the rigid outer shell 3 and the shock absorbent padding 2.

A disadvantage of this type of design is that the shin-knee and the shin-ankle transition areas of the wearer's leg are not well protected because the cantilever mechanism tends to "bottom out" in those regions. The term "shin-knee transition area" is defined to mean the area of the leg generally below the patella that in a kneeling position would contact the surface upon which the leg is kneeling. Bottoming out occurs when a force on the rigid outer shell results in the shock absorbent padding traversing the air cavity to directly abut against the inner surface of the rigid outer shell component. As a consequence, the force dissipating affect that would otherwise be accomplished by the cantilever mechanism is not fully effective.

The bottoming out problem is of further concern along and near the longitudinal stitch lines where the shock absorbent padding is attached to the rigid outer shell component(s). In those regions the depth of the air cavity just anterior to the lateral and medial sides of the wearer's leg are small in comparison to the depth of the air cavity along the front side of the wearer's leg. Thus, a force or impact blow to the outer shell is more likely to bottom out the cantilever in those regions.

A cantilever type construction, that simply increases or varies the tension and/or rigidity of the shock absorbent padding with respect to the rigid outer shell component(s) is not an effective solution for at least the following three reasons. First, it would add increased complexity to design and manufacture and as a consequence increase the manufacturing costs. Second, it would increase the bulkiness of the leg protector thereby tending to hamper the agility and mobility of the wearer. Third, the increased rigidity would, in this type of construction, directly diminish the effective absorption of a given force or impact.

The bottoming out problem is typically of concern at the bottom and top ends of the shin portion of the leg protector (i.e. the shin-knee transition and the shin-ankle transition) because the cantilever mechanism construction loses rigidity when approaching the ends of the rigid outer shell components. This is further aggravated by the fact that those transition regions tend to have relatively less muscle tissue to absorb a force. The concern with bottoming out is particularly acute in the shin-knee transition area of the leg because, unlike the shin-ankle transition area, the shin-knee transition area of the leg protrudes outwardly relative to the lower portion of the shin. Furthermore, the shin-knee transition area is typically the area directly impacted when the wearer is in a kneeling position due to a fall on the shin(s) to a hard surface or alternatively when the wearer is kneeling, perhaps to lay floor tile.

Apparently cognizant of this problem, some have stitched or attached the top and bottom ends of the shock absorbent padding to the rigid outer shell component to provide added rigidity to the cantilever mechanism. However, this construction simply results in the reduction of the relative size of the area where the cantilever mechanism is susceptible to bottoming out and, thus, does not eliminate the problem. Furthermore, any force to the stitched areas, regardless of magnitude, is directly absorbed by the padding and consequently the underlying leg rather than being dissipated via the cantilever mechanism.

Alternatively, others, perhaps also cognizant of these concerns, have provided additional shock absorbent padding in the shin-knee transition area. While the added padding, to a certain degree, may attenuate a given blow or force, it nevertheless directly transfers the blow or force to the underlying bones and joints often causing pain and/or bone or joint damage to the wearer. Furthermore, providing additional padding tends to both move the outer shell component further from the wearer's leg and increase the bulk of the leg protector. As a result, the wearer's agility and mobility on the playing arena or in the work environment is hampered.

Consequently, a need exists for an improved limb protector that can adequately protect the limb of the wearer.

SUMMARY OF THE INVENTION

The present invention is directed to an apparatus for protecting the limb of the wearer.

In the preferred embodiment the apparatus may comprise of an outer shell shin element generally shaped to curve concavely about the shin portion of the leg so as to partially encircle the leg. A raised groove element protrudes from the outer shell shin element in a direction outward from the shin to form a shin-knee transition cavity generally located between the shin-knee transition area of the leg and the inward facing surface of the outer shell shin element. An inner shock absorbent padding element is coupled to the outer shell shin element so as to create a gap between the inner shock absorbent padding element and the apex of the inward facing surface of the outer shell shin element.

In another preferred embodiment, the apparatus may comprise of an outer shell knee element generally shaped to curve concavely about the knee and the shin-knee transition area of the leg so as to partially encircle the leg of the wearer. A centrally positioned domed element protrudes in a direction outward from the knee to form a cavity between itself and the patella and the shin-knee transition area of the leg. The outer shell element has a lateral member positioned on the lateral side of the domed element and a medial member positioned on the medial side of the domed element. A padding element is positioned between the leg and the outer shell knee element and adjacent with the lateral and medial members of the outer shell knee element.

In another preferred embodiment, the apparatus may comprise an outer shell knee element and an outer shell shin element. The outer shell shin element is generally shaped to curve concavely about the shin portion of the leg so as to partially encircle the leg and is pivotally coupled to the outer shell knee element. An inner shock absorbent padding element is positioned between the leg and the outer shell shin element and the outer shell knee element and is substantially formed of a plurality of interconnected fluid-filled cushion elements.

In a another preferred embodiment, the apparatus may comprise of an outer shell knee element and an outer shell shin element. The outer shell shin element is generally shaped to curve concavely about the shin portion of the leg so as to partially encircle the leg and is pivotally coupled to the outer shell knee element. The outer shell shin element comprises an integrally formed raised groove element protruding in a direction outward from the shin to form a shin-knee transition cavity that is generally located between the shin-knee transition area of the leg and the inward facing surface of the outer shell shin element. An inner shock absorbent padding element is coupled to the outer shell shin element so as to create a gap between the inner shock absorbent padding element and the apex of the inward facing surface of the outer shell shin element.

In a another preferred embodiment, the apparatus may comprise of an outer shell knee element and an outer shell shin element. The outer shell shin element is generally shaped to curve concavely about the shin portion of the leg so as to partially encircle the leg and is pivotally coupled to the outer shell knee element. An inner shock absorbent padding element is coupled to the outer shell shin element so as to create a gap between the inner shock absorbent padding element and the apex of the inward facing surface of the outer shell shin element. The inner shock absorbent padding element comprises a first fluid-filled cushion element positioned to substantially overlie the knee and a second fluid-filled cushion element positioned to substantially overlie the shin-ankle transition of the leg.

DETAILED DESCRIPTION OF THE PREFERRED EMBODIMENT

Figure 1:
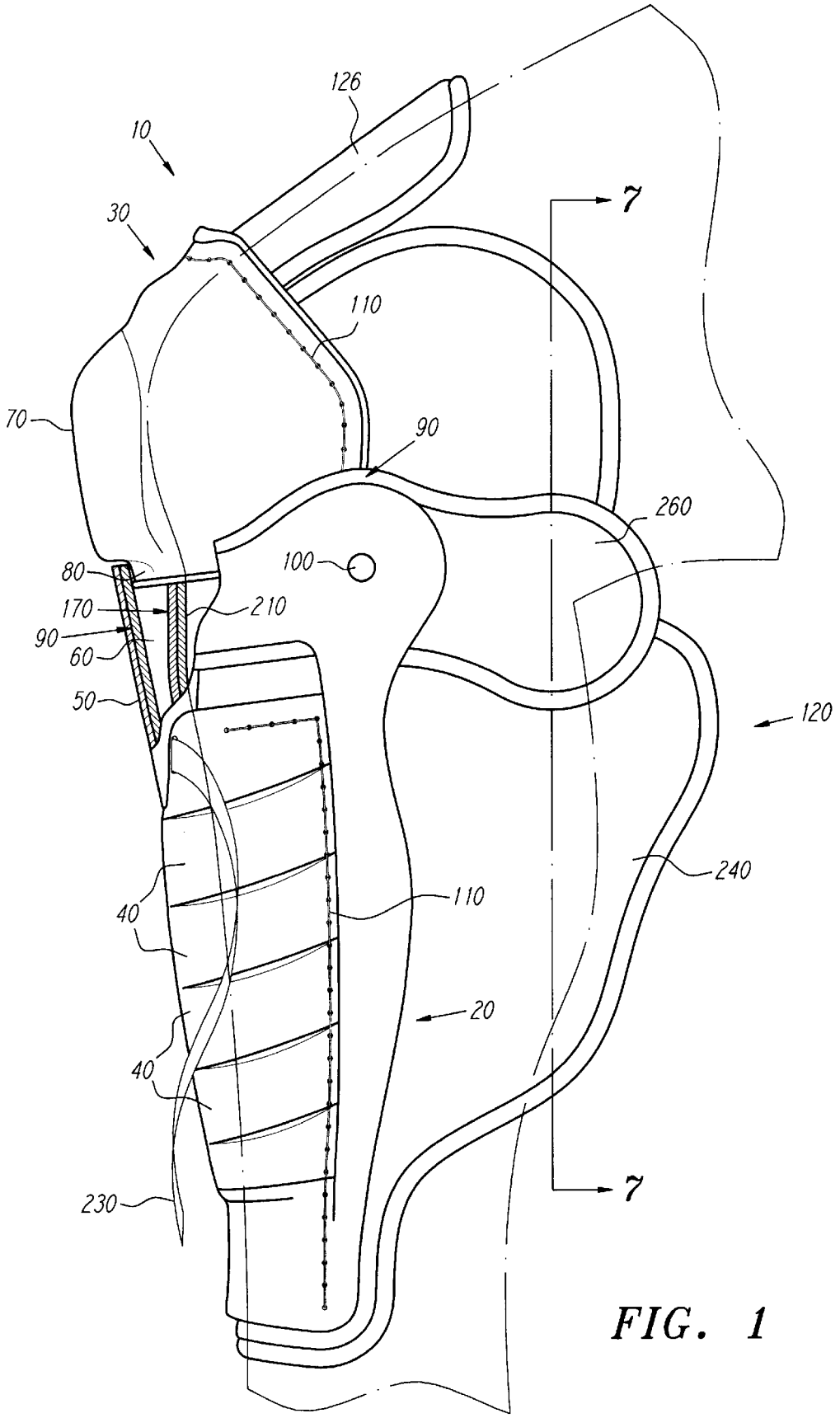
FIG. 1 is a partially cut-away of the left side view a first preferred embodiment of the invention and illustrates the wearer's leg in phantom.
Figure 2:
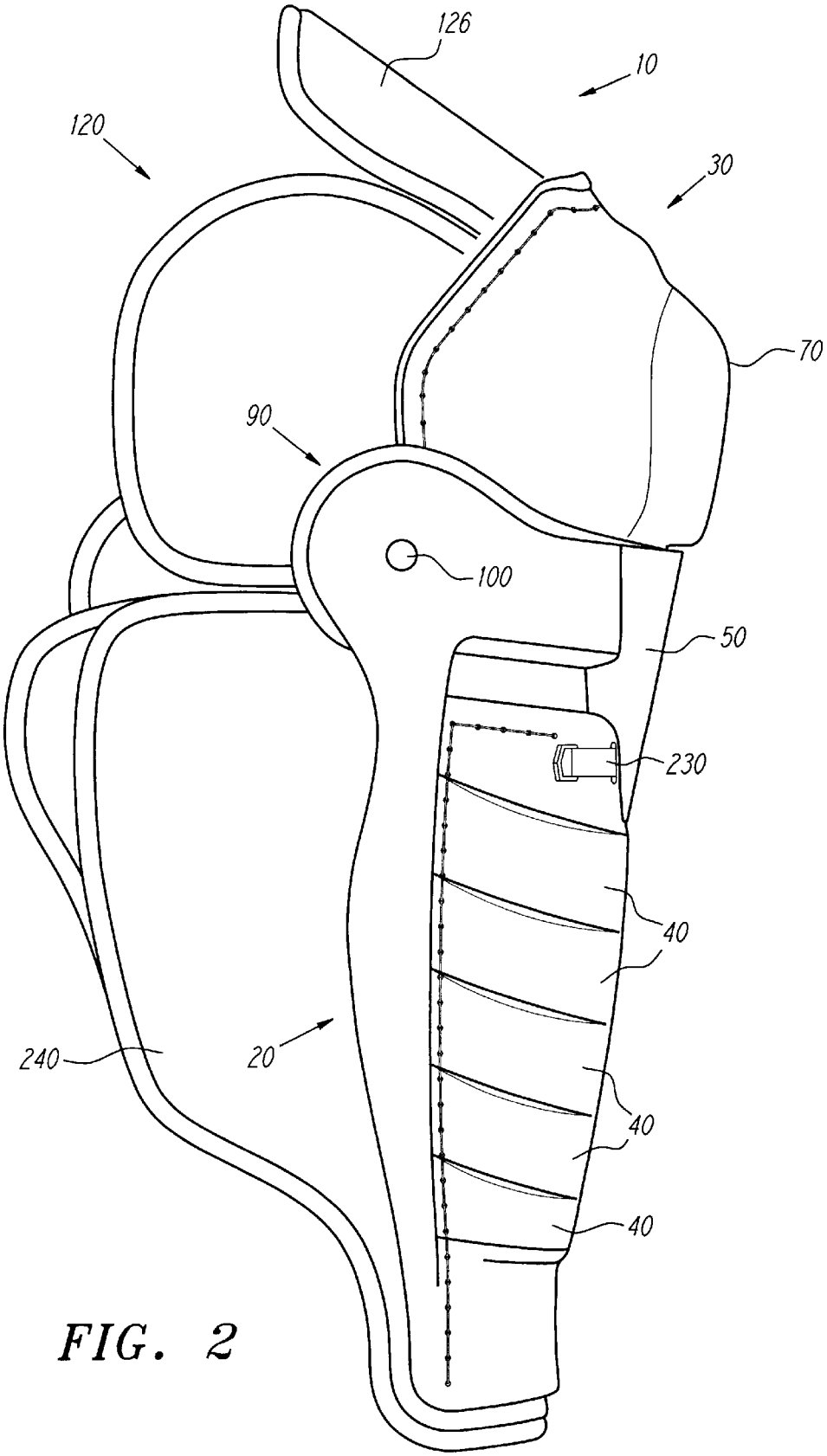
FIG. 2 is a right side view of the embodiment of FIG. 1.

The preferred embodiment will now be described with respect to the drawings. For clarity of description, any reference numeral representing an element in one figure shall represent the same element in any other figure. Furthermore, in describing a preferred embodiment of the invention illustrated in the drawings, specific terminology will be resorted to for the sake of clarity. However, the invention is not intended to be limited to the specific terms so selected, and it is to be understood that each specific term includes all equivalents.

FIGS. 1–8 illustrate a first preferred embodiment of a leg protector apparatus 10 of the present invention. The apparatus has two rigid outer shell elements 20 and 30 that are preferably made of molded shock resistant plastic. The first is the outer shell shin element 20 which is concavely curved about its longitudinal axis (i.e. the length axis of the leg) so that it partially encircles the wearer's leg when placed thereon. It is dimensioned to extend from above the ankle to below the knee of the wearer. The second is the outer shell knee element 30 which is also generally concavely curved to conform to the curvature of the knee. The outer shell shin element 20 and the outer shell knee element 30 are pivotally coupled to allow for the natural articulation of the knee of the wearer.

Figure 3:
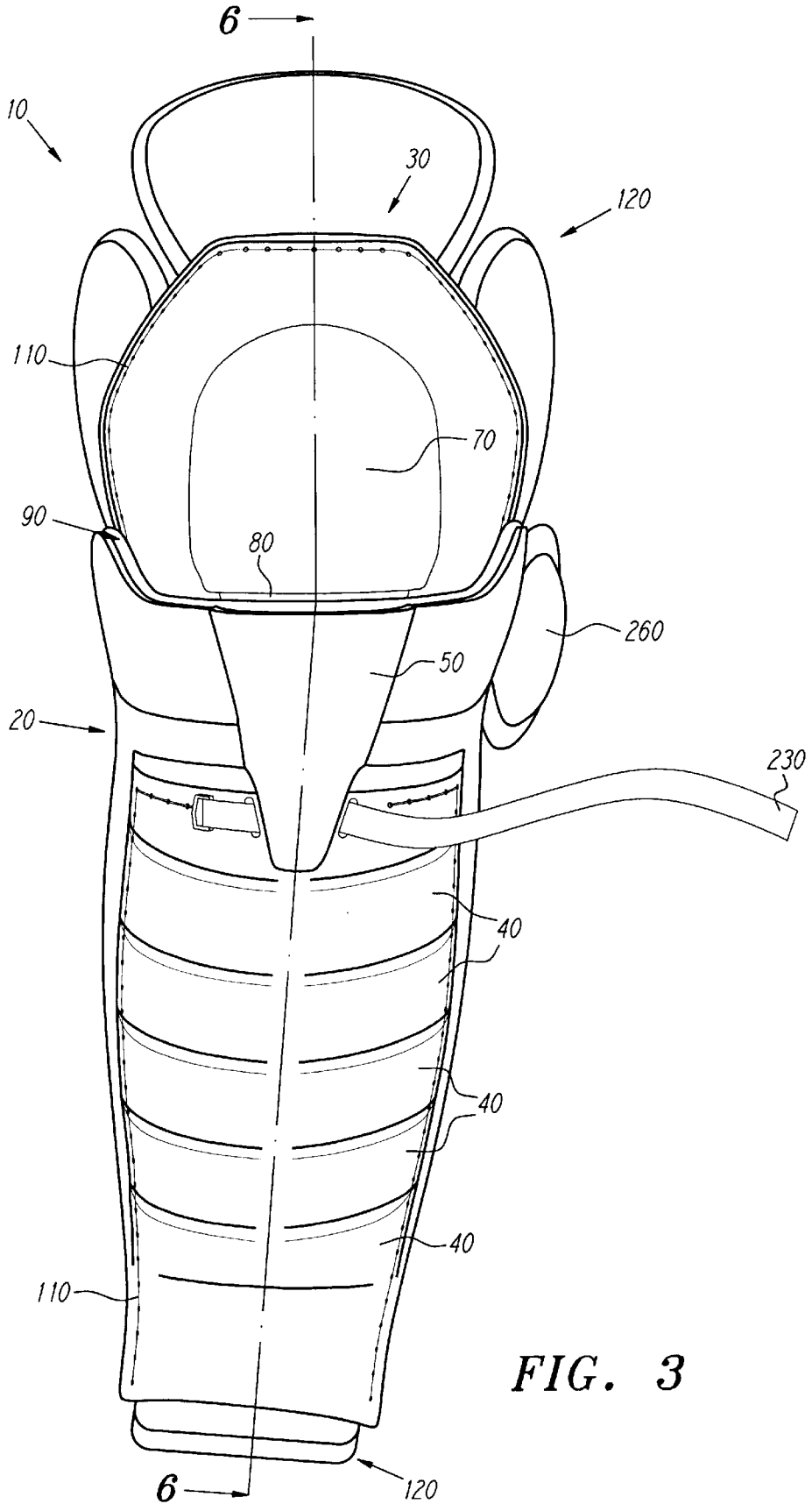
FIG. 3 is a front view of the embodiment of FIG. 1.

As shown in FIGS. 1, 2, 3, 5 and 6, the outer shell shin element 20 comprises a plurality of vertically spaced rib elements 40 and a raised groove element 50. The vertically spaced rib elements 40 assist in reinforcing the rigidity of the outer shell shin element 20. As best shown in the partial cut-away at the shin-knee transition area of the leg protector in FIG. 1, the raised groove element 50 is positioned to generally overlie the shin-knee transition of the wearer's leg. A shin-knee transition cavity 60 is thus created between the raised groove element 50 of the outer shell shin element 20 and the shin-knee transition area of the wearer's leg. Preferably, the raised groove element 50 is V-shaped with the open end of the V-shape pointed toward the outer shell knee element 30 as generally illustrated in FIG. 3. While other shapes are feasible, the V-shape provides an adequate shin-knee transition cavity 60 over the shin-knee transition of the wearer's leg while also providing a low profile fit.

The outer shell knee element 30 comprises a centrally placed domed element 70 protruding from the outer shell knee element 30 away from the leg of the wearer. A tongue element 80 is integrally formed with the domed element 70 and is positioned on the lower edge of the outer shell knee element 30 (i.e. the edge of the outer shell knee element 30 that is generally pointing toward the foot of the wearer). The tongue element 80 is dimensioned to pivotally interlock within the raised groove element 50 of the outer shell shin element 20. The interlocking configuration between the tongue element 80 and the raised groove element 50 assists in protecting the wearer's leg from hyper-extending.

Pivoting between the outer shell knee element 30 and the outer shell shin element 20 is, preferably, facilitated by employing a coupling element 90. The coupling element 90 is positioned between the outer shell shin element 20 and the outer side (i.e. the side away from wearer's leg) of the lower edge of the outer shell knee element 30. The coupling element 90 may be pivotally mounted to the outer shell shin element 20 or to the outer shell knee element 30 by suitable means.

Preferably, two opposed rivets 100, positioned at the lateral and medial side of the leg protector 10, couple the outer shell shin element 20 to the coupling element 90. The lower edge of the outer shell knee element 30 is secured to the coupling element 90 using a suitable fastening means such as stitching or rivets. While any portion of the lower edge of the outer shell knee element 30 may be secured to the coupling element, in the preferred embodiment, heavy stitching 110 attaches the tongue element 80 to the coupling element 90 to secure the outer shell knee element 30 to the coupling element 90. Thus, pivoting movement between the outer shell shin element 20 and the outer shell knee element 30 is achieved.

It should be understood that pivoting between the shin and the knee could be achieved by other suitable coupling. For example, the outer shell shin and outer shell knee elements 20 and 30 could be directly pivotally coupled together by rivets or other suitable means such as pin, snaps hooks or the like. Alternatively, the outer shell knee element 30 could be riveted to the coupling element 90 and the top edge of the outer shell shin element 20 could be attached by suitable means such as heavy stitching or rivets to the coupling element 90.

While the coupling element 90 may be formed of any suitable material including plastic and metal, the preferred embodiment employs a shock absorbent padding material. The shock absorbent padding provides the added benefit of cushioning interactions between the overlapping regions of the two rigid outer shell elements 20 and 30. The cushioning effect of the absorbent padding also minimizes or eliminates the sounds of the plastic interacting with plastic that would otherwise be produced between the overlapping regions of the two rigid outer shell elements 20 and 30 if these two elements were directly coupled to one another.

Figure 5:
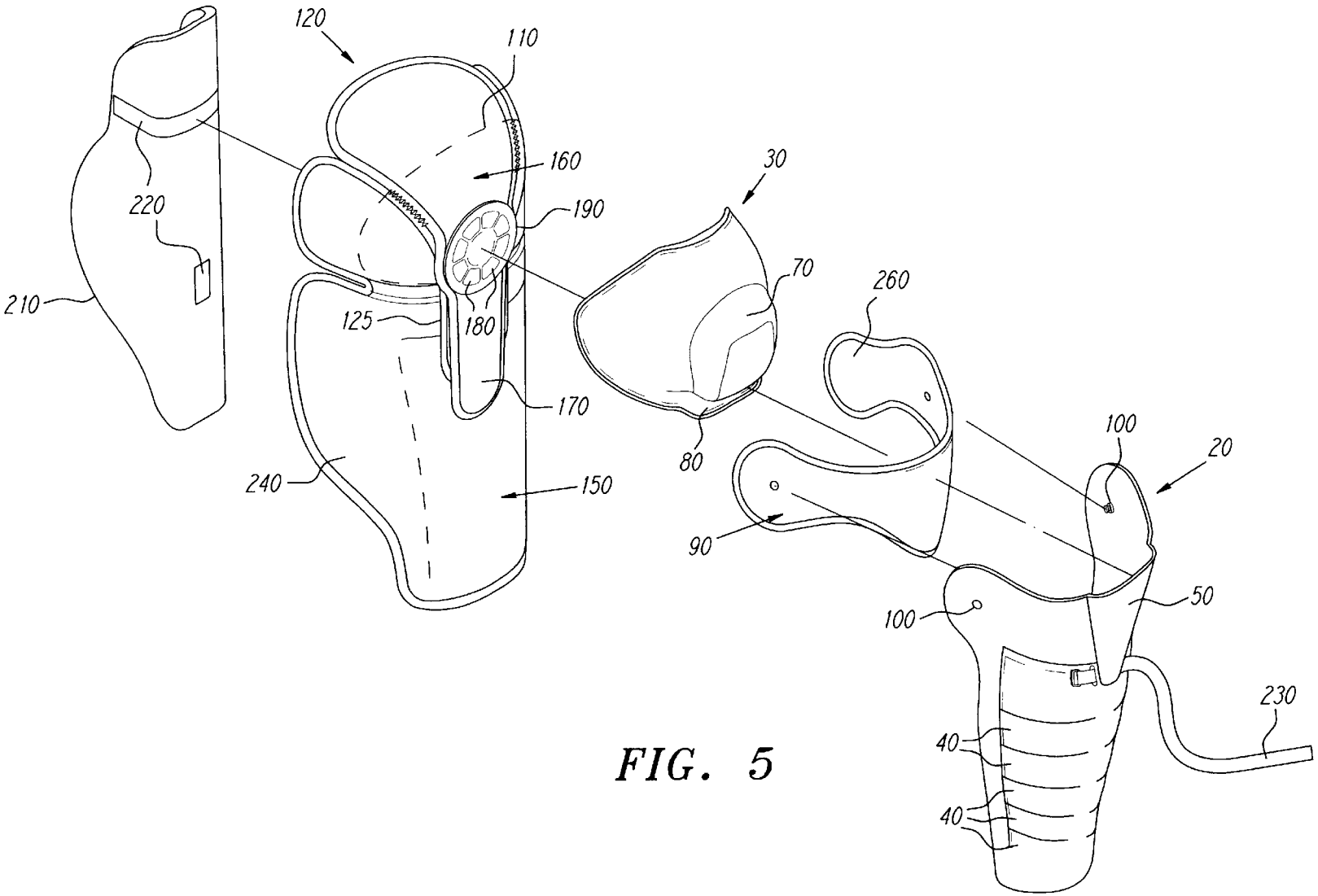
FIG. 5 is an exploded right side perspective view of the embodiment of FIG. 1.
Figure 6:
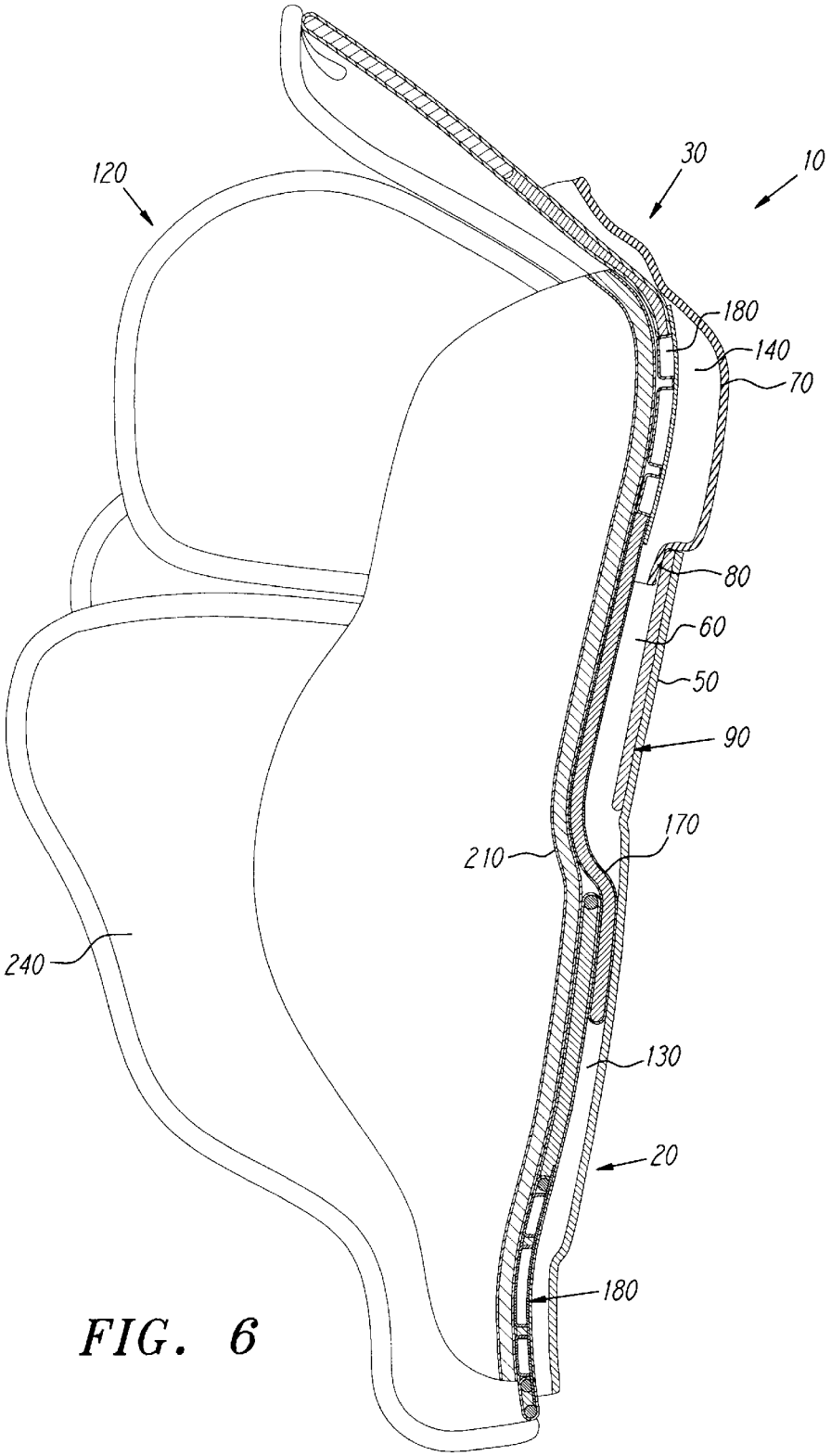
FIG. 6 is a cross-sectional view of the embodiment of FIG. 1 along line 6—6 shown in FIG. 3.

As best illustrated in FIGS. 1, 2, 3, 5 and 6, a shock absorbent padding element 120 is secured preferably by heavy stitching 110 to the peripheral of the outer shell shin element 20 and the outer shell knee element 30 so as to provide two discrete cavities 130 and 140 as best illustrated in FIG. 6. The shock absorbent padding element 120 has generally two members. A first member generally underlies the outer shell shin element 20. A second member generally underlies the outer shell knee element 30. It should be understood that the shock absorbent padding element 120 while illustrated as a single integral piece, may be formed of two or more non-integral members that are separately attached to the outer shell shin element 20 and/or to the outer shell knee element 30.

Preferably, the shock absorbent padding element 120 is comprised of an inwardly positioned (i.e. toward the leg of the wearer) brushed nylon covering, a shock absorbent foam layer made of ethyl vinyl acetate (hereinafter referred to as "EVA") positioned outwardly from and directly adjacent to the brushed nylon covering, and a durable nylon mesh covering positioned outwardly from the foam layer made of EVA and generally facing toward the rigid outer shell elements 20 and 30. As best shown in FIG. 5, the shock absorbent padding element 120 further comprises a U-shaped opening 125 that is positioned generally underneath the raised groove element 50 of the outer shell shin element 20. The base of the U-shape, preferably, extends below the shin-knee transition area of the leg so that the U-shaped opening 125 substantially overlies the shin knee transition area.

Figure 8:
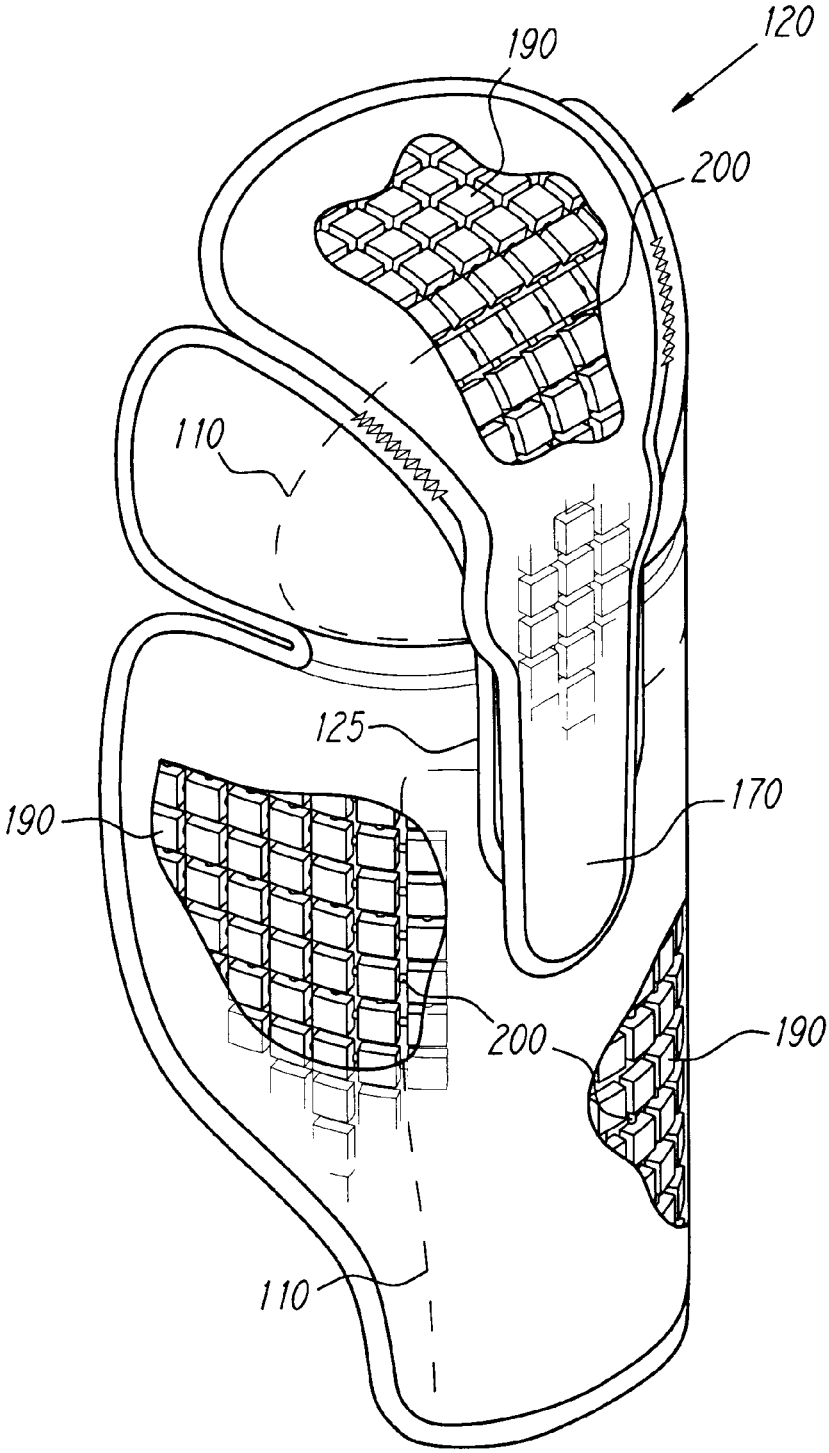
FIG. 8 is front perspective view of an alternative embodiment of the shock absorbent padding element of the invention.

FIG. 8 depicts an alternative embodiment of the shock absorbent padding element 120. In this embodiment, the shock absorbent padding element 120 is substantially formed of a plurality of discrete fluid filled compartments 190. Fluid passageways 200 interconnect the discrete fluid filled compartments 190 and, thus, transfer pressure from one discrete fluid filled compartment 190 to another. The transfer of pressure allows for efficient absorption of high energy impacts. The high energy absorption characteristics of the interconnected fluid filled compartments 190 provides improved protection to the leg of the wearer, especially in the regions susceptible to bottoming out such as around the stitch lines and around the shin-knee and shin-ankle transition areas. The fluid-filled compartments 190 are described in further detail below. It should be understood that the high energy absorption characteristics of the interconnected fluid filled compartments 190 make it suitable to be attached in a non-spaced relation with the outer shell components 20 and 30 and yet still provide adequate absorption.

As previously noted and best illustrated in FIG. 6, two discrete cavities 130 and 140 exist between the shock absorbent padding element and the two rigid outer shell elements 20 and 30. The first cavity is the shin cavity 130 which is located along the inside surface of the outer shell shin element 20. The second cavity is the knee cavity 140 which is positioned on the inside surface of the outer shell knee element 30. The shin-knee transition cavity 60, the shin cavity 130, and the knee cavity 140 are positioned adjacent to one another along the inward facing surfaces of the rigid outer shell elements 20 and 30.

As best illustrated by the shaded areas in FIG. 5, located on the shock absorbent padding element 120 and directly underlying the two discrete cavities 130 and 140 are two discrete impact absorption and dissipation areas 150 and 160. The first is a shin-impact absorption and dissipation area 150 which is the region on the shock absorbent padding element 120 generally defined by the area within the heavy stitching 110 that attaches the shock absorbent padding element 120 to the outer shell shin element 20. The second is the knee-impact absorption and dissipation area 160 which is the region on the shock absorbent padding element 120 generally enclosed by the heavy stitching 110 that attaches the shock absorbent padding element 120 and the outer shell knee element 30.

The shock absorbent padding element 120 in conjunction with the outer shell shin element 20 functions as a cantilever mechanism in the impact absorption and dissipation areas 150 and 160. In operation, a force or impact (perhaps resulting from a fall or being hit by a puck, hockey stick or the like) against the outer shell shin element flexes the shin-impact absorption and dissipation area 150 relative to the underlying impacted outer shell shin element 20. Thus, the force is dissipated across the shin-impact absorption and dissipation area 150 to the underlying areas of the leg of the wearer. Furthermore, impacts of sufficient magnitude to the outer shell shin element 20 are also partially transferred to the outer shell knee element 30 via the interaction of the overlapping regions of the rigid outer shell elements 20 and 30. Thus, further dissipation of the impact across the leg of the wearer is achieved.

In the occurrence of an impact to the outer shell knee element 30, the knee-impact absorption and dissipation area 160 facilitates the transfer of the impact from the joint areas underlying the knee to the surrounding tissue. Alternatively, in the occurrence of an impact to the outer shell shin element 20, the shin-impact absorption and dissipation area 150 facilitates the dissipation of the shock to the underlying areas of the leg which, do to the U-shaped opening 125, does not include the shin-knee transition. The fact that the shin-knee transition area is not subject to absorbing an impact directed to the outer shell shin element 20 is of particular advantage in the occurrence where the wearer falls to a hard surface such as ice or the hockey arena boards. In such an occurrence the foot of the wearer usually impacts the hard surface and tends to bend the knee. The result is that the area of the outer shell shin element 20 overlying the shin-knee transition area of the leg (i.e. the raised groove element 50) receives the bulk of the force or impact. This force or impact is transferred via the cantilever mechanism to the shin-impact absorption and dissipation area 150 located generally below the shin-knee transition of the wearer's leg and above the ankle. The absorption of the force or impact in the area below the shin-knee transition is preferable because there is more muscle tissue surrounding the tibia and fibula bones of the wearer's leg in those regions to absorb the force or impact.

As best shown in FIGS. 5 and 6, the shock absorbent padding element 120, preferably, further comprises an elongated flange element 170 and two high-energy absorbing fluid-filled cushion elements 180. The elongated flange element 170 is unattached along its sides, as showin FIGS. 5 and 8 allowing it to move upward along the longitudinal axis of the leg protector with the bending of the knee and downward along the longitudinal axis of the leg protector with the straightening of the knee. The elongated flange element 170 is, preferably, dimensioned to fit within the U-shaped opening 125 of the shock absorbent padding element 120 and to overlap the base of the U-shaped opening 125 as shown in FIG. 5 and 8. The overlapping configuration provides extra padding at the base of the U-shaped opening 125 and is desirable because the base of the U-shaped opening 125 generally defines the top end (i.e. the end closest to the knee) of the cantilever mechanism protecting the shin. This area of the cantilever mechanism is more susceptible to bottoming out than the mid-section of the cantilever mechanism. It should be understood, however, that the susceptibility of bottoming out in this regard is not as great as that typically found in leg protectors employing conventional cantilever mechanism. The improved resistance to bottoming out is due to the added rigidity provided by the outer shell shin element 20 extending beyond the base of the U-shaped opening 125 and, therefore, beyond the top end of the cantilever mechanism protecting the shin.

Figure 4:
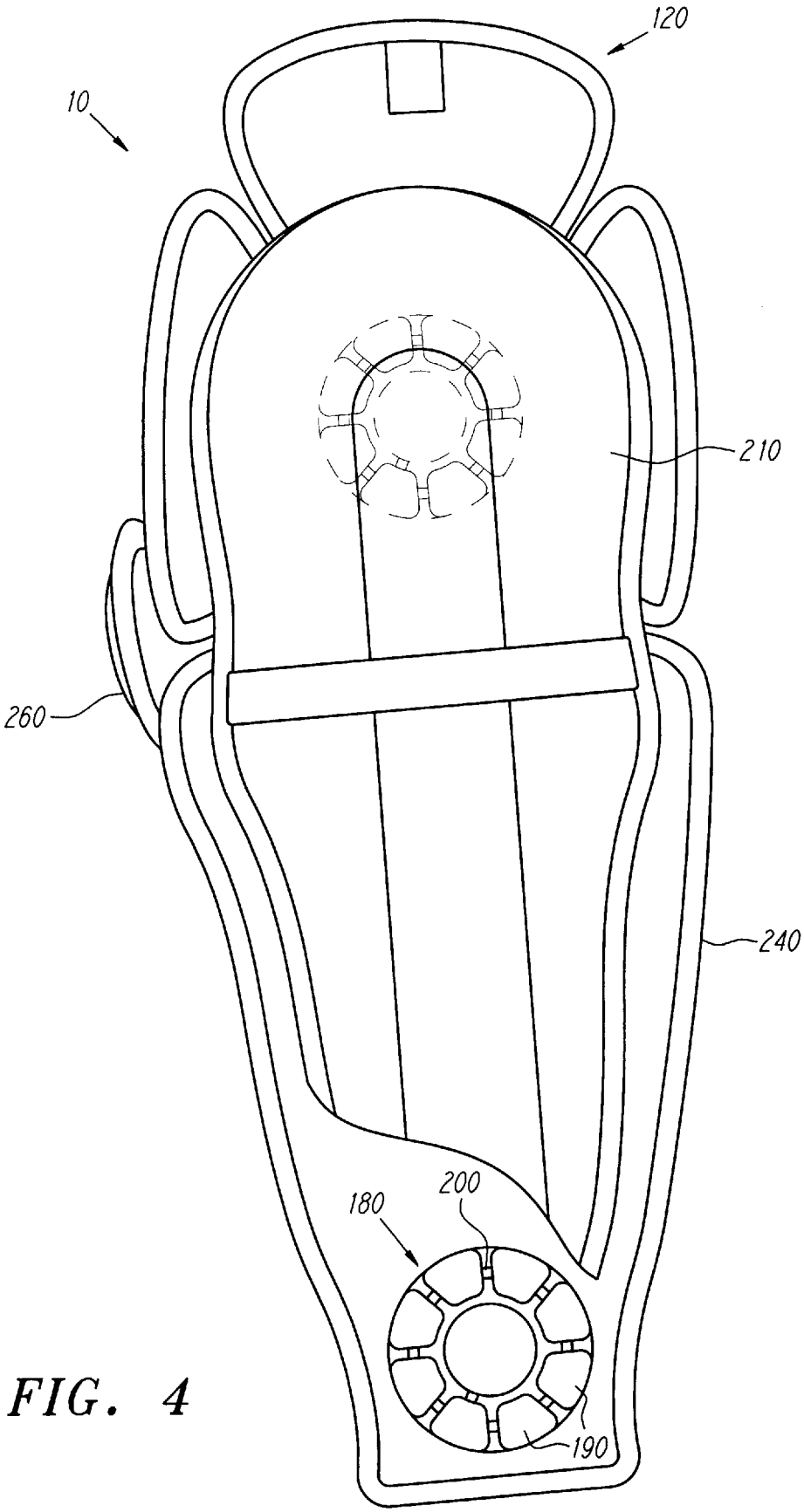
FIG. 4 is a partial cut-away of the rear view of the embodiment of FIG. 1.

Turning now to the two high-energy absorbing fluid-filled cushion elements 180 depicted in FIGS. 4, 5 and 6. One of the fluid-filled cushion elements 180 is positioned to overlie the knee cap and the other is positioned to overlie the shin-ankle transition of the leg of the wearer. The fluid-filled cushion elements 180 preferably comprise a plurality of discrete fluid filled compartments 190 made of a fluid impermeable flexible material. The discrete fluid filled compartments 190 are interconnected to one or more adjoining compartments by small fluid passageways 200. The fluid passageways 200 facilitate the transfer of pressure between the compartments and, thus, function to dissipate and absorb an impact force across the plurality of discrete fluid filled compartments 190. The fluid-filled cushion elements 180 may be made of polyurethane or a blend of vinyl-polyurethane material. While the fluid-filled cushion elements 180 may encapsulate liquid and/or gas, the preferable construction preferred embodiment encapsulates air. The interconnected fluid filled compartments 190 may be manufactured by bonding polyurethane material sheets together in a preferred pattern and then forming the discrete fluid filled compartments 190 by air blow molding.

In operation, the fluid-filled cushion elements 180 achieve superior shock absorbing characteristics than the known foam shock absorbing padding. This characteristic is particularly suitable for cushioning the impact at the shin-ankle transition area where the cantilever mechanism is susceptible to bottoming out. Furthermore, by positioning a fluid-filled cushion element 180 above and surrounding the patella of the knee, improved cushioning to the underlying knee is achieved.

As best shown in FIGS. 4, 5 and 6, a perspiration absorbing element 210 may be provided to absorb the perspiration of the wearer. The perspiration absorbing element 210 is preferably, removably attached by suitable means to the first shock absorbing element 120, preferably, by means of VELCRO strips 220, which readily adhere to the brushed nylon covering of the shock absorbent padding element 120. Thus, the perspiration absorbing element 210 can be easily cleaned or washed separately from the remaining portions of the leg protector. In the preferred embodiment, the perspiration absorbing element 210 is formed of an absorbent open-cell polyurethane foam material encapsulated by an open mesh nylon liner. The open mesh nylon liner separates the wearer's leg from the absorbent foam element and functions to wick perspiration away from the leg of the wearer to the absorbent open-cell polyurethane foam.

As depicted in FIGS. 1, 2, 3, and 5, a leg strap 230 is provided to secure the leg protector about the leg of the wearer. The strap 230 is strategically positioned centrally on the outer shell shin element so that when the strap 230 is secured to the leg of the wearer the outer shell shin element 20 tends to flex centrally at and around the apex of its concave curvature along its longitudinal axis thereby increasing the depth of the shin-knee transition cavity 60 that underlies the raised groove element 50. Other straps 230 may also be supplied to further secure the leg protector near the ankle. Alternatively or in combination with the strap(s), tape, VELCRO bands, elastic bands or the like may be utilized by the wearer to secure the leg protector to the leg for proper placement and operation.

As best shown in FIGS. 1, 2, 5 and 7, in the first preferred embodiment, shock absorbent flange elements 240 are formed integral with the shock absorbent element 120 to protect the lateral, medial and posterior (i.e. back) sides of the wearers leg. Preferably, these shock absorbent flange elements 240 contain resilient plate elements 250 interposed within the shock absorbent foam layer of EVA to provide the wearer with improved protection from impacts to the backside of the wearer's leg. These resilient plate elements 250 may be formed of high density polyethylene or any other suitable material.

Figure 7:
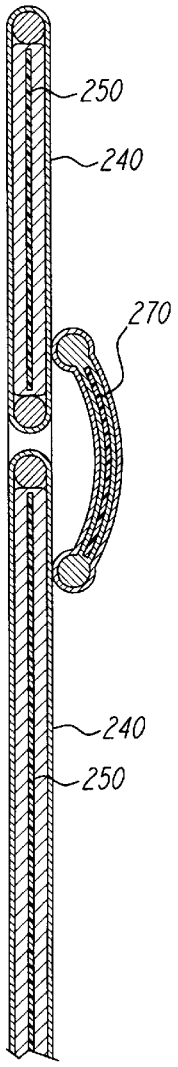
FIG. 7 is a cross-sectional view of the embodiment of FIG. 1 along line 7—7 of the apparatus of FIG. 1 as therein indicated.

As illustrated in FIGS. 1, 3 and 7, the coupling element 90 also assists in protecting the lateral and posterior sides of the wearer's leg by providing an integrally formed ligament protection element 260. The ligament protection element 260 is positioned to overlie the outside lateral ligament of the wearer's leg. It should be understood that the ligament protection element 260 could extend from the rigid outer shell elements 20 and 30 or other suitable structures such as the absorbent padding element 120. In the preferred embodiment, a rigid element 270 is interposed within the shock absorbent padding material that forms the coupling element 90. The positioning of the rigid element 270 in the shock absorbent padding material is similar to that of the positioning of the resilient plate elements 250 within the shock absorbent foam layer of EVA. The rigid element 270 is, preferably, shaped as a concaved disc protruding outward from the leg of the wearer. This is depicted in FIG. 7. Thus, an impact to the ligament protection element 260 will transfer the force to the edge of the concave disc and, consequently, to the tissue surrounding the ligament. Therefore, direct injury to the ligament is minimized.

It is to be understood that while the leg protector apparatus of the first preferred embodiment illustrates two rigid outer shell elements 20 and 30, either outer shell element may function independently and separately from one another in combination with the underlying padding to protect the leg of the wearer. For example, the outer shell shin element 20 may function in combination with the underlying member of the shock absorbent padding element 120 as a separate and independent leg protector apparatus for protecting the shins of soccer participants and the like or alternatively may be employed as protection for the wearer kneeling, perhaps to lay floor tile.

Furthermore, as described in detail below and illustrated in the second preferred embodiment depicted in FIGS. 9–11, the outer shell knee element 30 in combination with a padding element 300 may be employed separately as protection for a worked required to kneel to perform his occupational activities such as laying floor tile, wood working, laying concrete, and the like. The independent and separate utility of the outer shell knee element 30 in this regard is described in further detail below.

Figure 9:
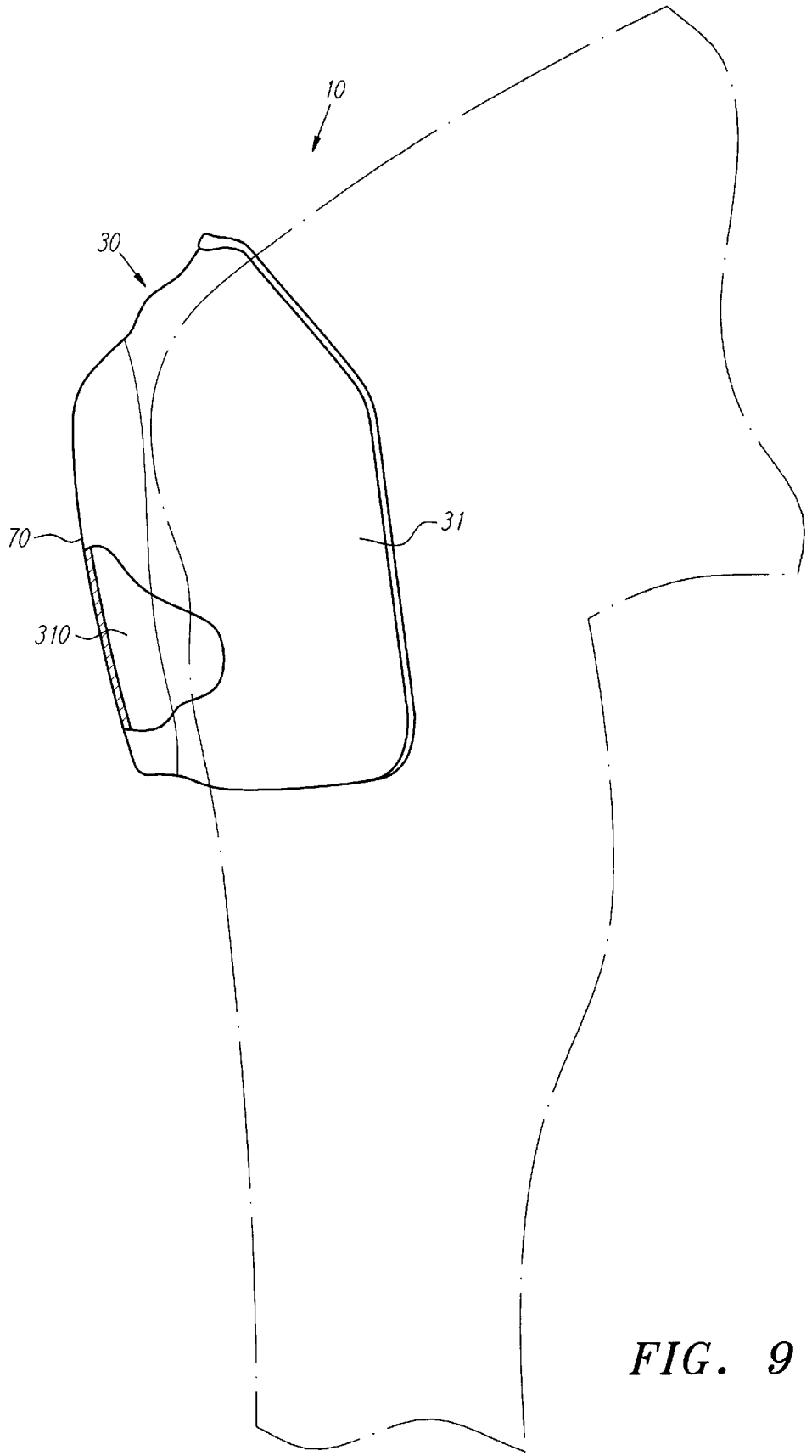
FIG. 9 depicts a left side view of a second preferred embodiment of the invention and illustrates the wearer's leg in phantom.
Figure 10:
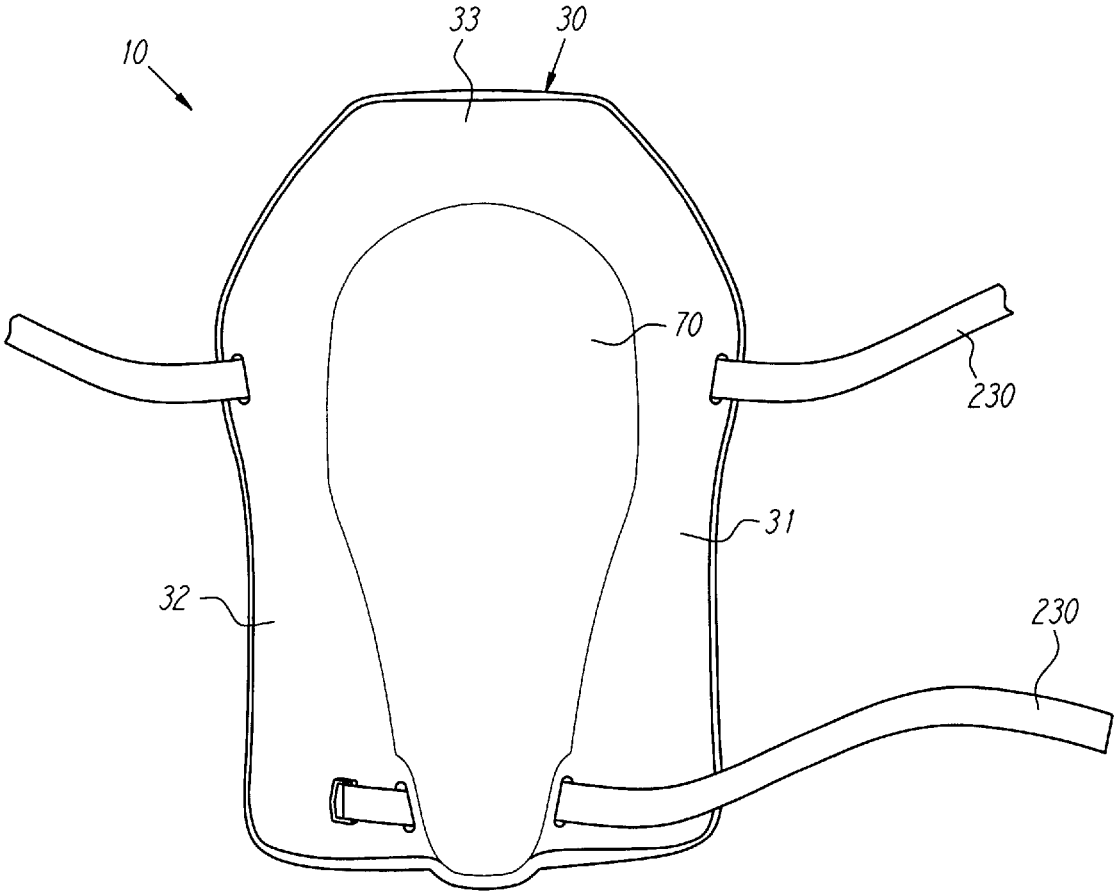
FIG. 10 is a front view of the embodiment of FIG. 9.
Figure 11:
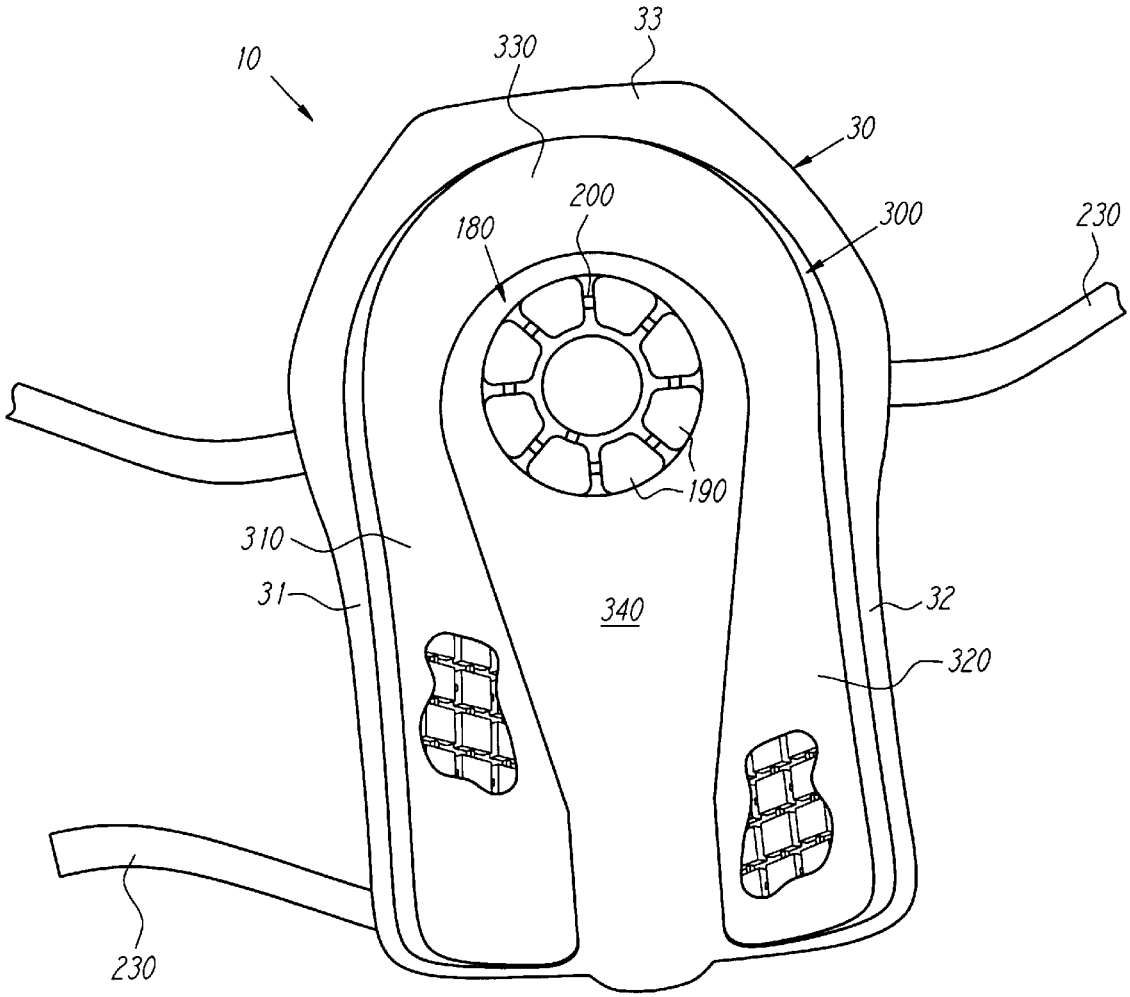
FIG. 11 a rear view of the embodiment of FIG. 9.
Figure 12A:
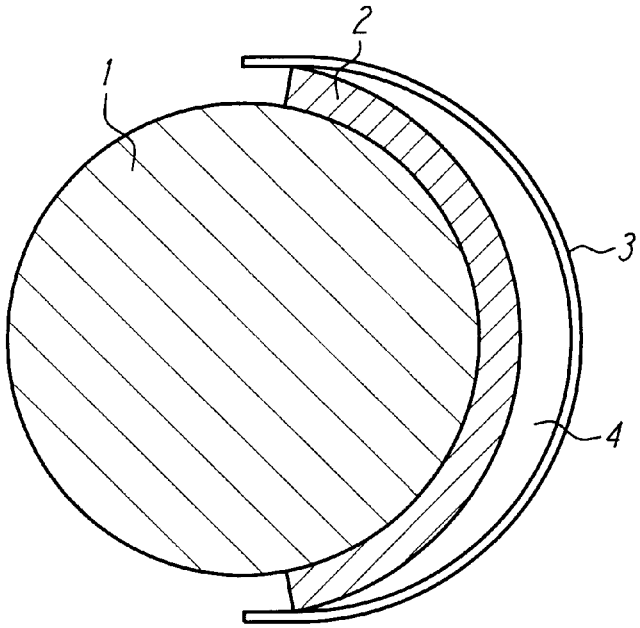
FIG. 12A is a schematic depicting a leg protector employing a cantilever mechanism.
Figure 12B:
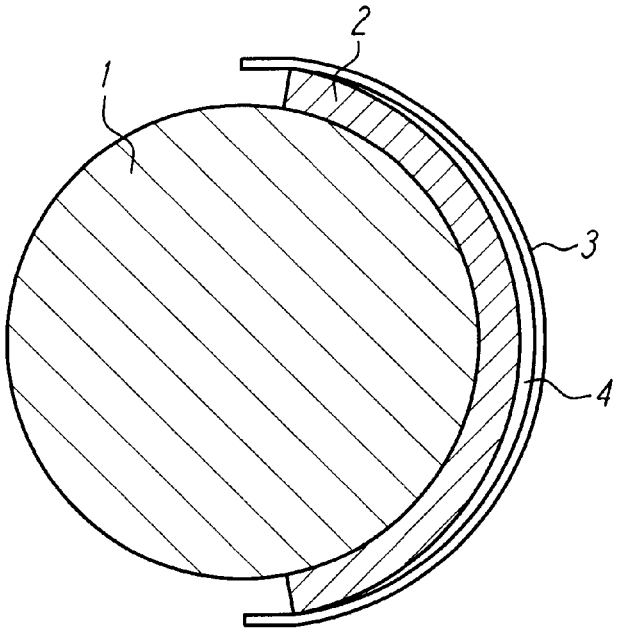
FIG. 12B is the schematic of FIG. 12A illustrating the cantilever mechanism in a flexed position.

FIGS. 9–11 illustrate a second preferred embodiment of a leg protector apparatus 10. Unless otherwise noted the materials employed in the first preferred embodiment of the leg protector apparatus 10 may also be employed in the corresponding elements of the second preferred embodiment of the leg protector apparatus. Referring to FIGS. 9 and 10, the leg protector apparatus 10 of the second preferred embodiment comprises a rigid outer shell knee element 30 that generally overlies the knee and a portion of the shin of the leg of the wearer. The outer shell knee element 30 is generally concavely curved to conform to the curvature of the underlying leg. The outer shell knee element 30 is, preferably, dimensioned to extend from above the patella to below the shin-knee transition area. The outer shell knee element 30 comprises a domed element 70 that protrudes outwardly (i.e. away from the leg of the wearer). The doomed element 70 is dimensioned to generally overlie the patella and the shin-knee transition area of the leg and forms a cavity 310 generally between the patella and shin-knee transition areas of the leg of the wearer and the opposed inner surface (i.e. the surface facing the leg of the wearer) of the domed element 70. The outer shell knee element 30 comprises a lateral support member 31 and a medial support member 32 positioned respectively on the lateral and medial sides of the domed element 70. The outer shell knee element 30 further comprises a superior support member 33 positioned superior to the patella of the leg of the wearer.

As depicted in FIG. 11, a padding element 300 is positioned adjacent with the inner surface (i.e. the surface facing the leg of the wearer) of the outer shell knee element 30. Preferably, the padding element 300 comprises a lateral member 310, a medial member 320 and a superior member 330. The lateral member 310 is generally positioned adjacent to the inner surface of the lateral support member 31 of the outer shell knee element 30. The medial member 320 is generally positioned adjacent to the inner surface of the medial support member 32 of the outer shell knee element 30. A space 340 is formed between the medial side of the lateral member 310 and the lateral side of the medial member 320. The space 340 defines the area of the leg underlying the outer shell shin element 30 that does not absorb pressure from a force applied to the rigid outer shell knee element 30. Preferably, space 340 should overlie the patella and the shin knee transition area of the leg. The padding element 300 may be formed of the same materials as the shock absorbent padding element 120 described in the first preferred embodiment of the leg apparatus.

As illustrated in FIG. 11, a high-energy absorbing fluid-filled cushion element 180 is, preferably, employed and is positioned to overlie the patella for added protection to that knee cap area. The fluid-filled cushion element 180 comprises the same elements as that previously described in the first preferred embodiment of the leg apparatus. Namely, it comprises a plurality of discrete fluid filled compartments 190 made of a fluid impermeable flexible material. The discrete fluid filled compartments 190 are interconnected to one or more adjoining compartments by small fluid passageways 200. The fluid passageways 200 facilitate the transfer of pressure between the compartments and, thus, function to dissipate and absorb a force across the plurality of discrete fluid filled compartments 190.

In operation, the leg protector is secured to the leg by the straps 230 or other suitable securing means. The padding element 300 functions to support the lateral and medial sides of the knee and the shin-knee transition areas so as to cradle the leg of the wearer. Thus, a force applied to the domed element 70 is transferred to the lateral and medial support members 31 and 32 of the outer shell knee element 30 and is consequently transferred to the padding element 300 and is absorbed by the lateral and medial members 310 and 320 of the padding element 300 and by the underlying lateral and medial portions of the leg contacting the lateral and medial members 310 and 320.

The foregoing specification and the drawings forming part hereof are illustrative in nature and demonstrate certain preferred embodiments of the invention. It should be recognized and understood, however, that foregoing description is not to be construed as limiting of the invention because many changes, modifications and variations may be made therein by those of skill in the art without departing from the essential scope, spirit or intention of the invention. Accordingly, it is intended that the scope of the invention be limited solely by the appended claims.

What is claimed is:

1. A leg protector for a knee, a shin and a shin-knee transition area of a leg the shin-knee transition area making contact with a flat surface upon kneeling, comprising:

an outer shell knee element;

an outer shell shin element pivotally coupled to the outer shell knee element, and generally arch shaped in cross section to define a concave side of the arch to overlay and partially encircle a leg and including a cavity in the surface of the concave side of the outer shell shin element at the apex of the arch at the shin-knee transition area;

an inner shock absorbent padding element coupled to the outer shell shin element substantially parallel and displaced from the apex of the arch on the concave side of the arch to define a gap between the inner shock absorbent padding element and the apex of the arch the inner shock absorbent padding element being coupled to the outer shell shin element to either side of the cavity and including an opening overlaying the cavity.

2. The leg protector of claim 1 wherein the outer shell knee element comprises a centrally positioned domed element defining a concavity to receive the knee and a tongue element integrally formed to said domed element and extending in a direction downward toward the ankle of the leg;

said tongue element being dimensioned to interlock with the cavity.

3. The leg protector of claim 2 wherein said inner shock absorbent padding element comprises a first fluid-filled cushion element positioned to substantially overlie the knee and a second fluid-filled cushion element positioned to substantially overlie the shin-ankle transition of the leg.

4. The leg protector of claim 3 wherein said pivotal coupling of said outer shell shin element to said outer shell knee element is facilitated by a coupling element positioned between the outward surface of said outer shell knee element and said inward facing surface of said outer shell shin element.

5. The leg protector of claim 4 wherein the opening overlaying the cavity is generally U-shaped.

6. The leg protector of claim 5 wherein said inner shock absorbent padding element further comprises an elongated flange element dimensioned to fit substantially within the opening overlaying the cavity.

7. The leg protector of claim 6 wherein said elongated flange element is dimensioned to overlap with a portion of said inner shock absorbent padding element that is generally located below the base of the U-shaped opening overlaying the cavity.

8. The leg protector of claim 7 further comprising a ligament protection element positioned to overlie the outside lateral ligament of the leg.

9. The leg protector of claim 8 wherein said ligament protection element comprises a shock absorbent padding and a rigid element shaped as a concaved disc and interposed within said shock absorbent padding so that its convex surface protrudes outward from the leg.

10. The leg protector of claim 9 further comprising a leg strap coupled to said outer shell shin element substantially near said apex of said outer shell shin element.

11. The leg protector of claim 1 wherein the cavity is V-shaped.

12. The leg protector of claim 1 wherein said inner shock absorbent padding element comprises a first fluid-filled cushion element positioned to substantially overlie the knee and a second fluid-filled cushion element positioned to substantially overlie the shin-ankle transition of the leg.

13. The leg protector of claim 12 wherein said first and second fluid-filled cushion elements encapsulates liquid.

14. The leg protector of claim 12 wherein said first and second fluid-filled cushion elements encapsulates gas.

15. The leg protector of claim 12 wherein said first and second fluid-filled cushion elements encapsulates both liquid and gas.

16. The leg protector of claim 1 wherein said pivotal coupling of said outer shell shin element to said outer shell knee element is facilitated by a coupling element positioned between the outward surface of said outer shell knee element and said inward facing surface of said outer shell shin element.

17. The leg protector of claim 16 wherein said coupling element is pivotally mounted to said outer shell shin element and suitably coupled to the outer shell knee element.

18. The leg protector of claim 16 wherein said coupling element is pivotally mounted to said outer shell knee element and suitably coupled to the outer shell shin element.

19. The leg protector of claim 16 wherein said coupling element is at least partially formed of a shock absorbent padding.

20. The leg protector of claim 16 wherein said coupling element is at least partially formed of plastic or metal.

21. The leg protector of claim 1 wherein the opening overlaying the cavity is generally U-shaped.

22. The leg protector of claim 21 wherein said inner shock absorbent padding element further comprises an elongated flange element dimensioned to fit substantially within the opening overlaying the cavity.

23. The leg protector of claim 22 wherein said elongated flange element is dimensioned to overlap with a portion of said inner shock absorbent padding element that is generally located below the base of the U-shaped opening overlaying the cavity.

24. The leg protector of claim 1 further comprising a ligament protection element positioned to overlie the outside lateral ligament of the leg.

25. The leg protector of claim 24 wherein said ligament protection element comprises a shock absorbent padding and a rigid element shaped as a concaved disc and interposed within said shock absorbent padding so that its convex protrudes outward from the leg.

26. The leg protector of claim 1 further comprising a perspiration absorbing element positioned between the leg and the inner shock absorbent element.

27. The leg protector of claim 26 wherein said perspiration absorbing element is attached to said inner shock absorbent padding element.

28. The leg protector of claim 26 wherein said perspiration absorbing element is removably attached to said inner shock absorbent padding element.

29. The leg protector of claim 1 further comprising a leg strap coupled to said outer shell shin element substantially near said apex of said outer shell shin element.

30. The leg protector of claim 1 wherein the inner shock absorbent padding element is substantially formed of a plurality of interconnected fluid-filled cushion elements.

31. A leg protector for a shin and a shin-knee transition area of a leg, the shin-knee transition area making contact with a flat surface upon kneeling, comprising:

an outer shell shin element generally arched shaped in cross section defining a concave side of the arch to overlay and partially encircle the shin and shin-knee transition area of a leg and including a cavity in the surface of the concave side of the outer shell shin element at the apex of the arch at the shin-knee transition area; and an inner shock absorbent padding element coupled to the outer shell shin element substantially parallel and displaced from the apex of the arch on the concave side of the arch to define a gap between the inner shock absorbent padding element and the apex of arch the inner shock absorbent padding element being coupled to the outer shell shin element to either side of the cavity and including an opening overlaying the cavity.

32. The leg protector of claim 31 wherein the cavity is V-shaped.

33. The leg protector of claim 31 wherein said inner shock absorbent padding element comprises a fluid-filled cushion element positioned to substantially overlie the shin-ankle transition area of the leg.

34. A leg protector for a knee and shin-knee transition area which makes contact upon kneeling of a flat surface, comprising:

an outer shell element generally dimensioned to extend from above the knee to the shin-knee transition area of the leg and generally arch shaped in cross section defining a concave side of the arch to overlay the knee and the shin-knee transition of the leg and including a cavity in the surface of the concave side of the outer shell knee element at the apex of the arch at the shin-knee transition area the outer shell element having a lateral member positioned on the lateral side of the cavity and a medial member positioned on the medial side of the cavity; and padding positioned between the leg and the outer shell element overlaying the lateral and medial members of the outer shell element and including an opening overlaying the cavity.

35. The leg protector of claim 34 wherein the padding is substantially formed of a plurality of interconnected fluid-filled cushion elements.

* * * * *